US005595530A

United States Patent [19]

Heidelberger

[11] Patent Number: 5,595,530

[45] Date of Patent: Jan. 21, 1997

[54] RECIPROCATING SANDER

[75] Inventor: Richard A. Heidelberger, Wheatfield, N.Y.

[73] Assignee: Dynabrade, Inc., Clarence, N.Y.

[21] Appl. No.: 381,116

[22] Filed: Jan. 31, 1995

[51] Int. Cl.[6] ..... B24B 23/00

[52] U.S. Cl. ..... 451/356; 451/164

[58] Field of Search ..... 451/356, 295, 451/344, 351, 164

[56] References Cited

U.S. PATENT DOCUMENTS

| | | | |
|---|---|---|---|
| 1,365,924 | 1/1921 | Lagerquist et al. | 451/356 |
| 2,743,557 | 5/1956 | Larson | 51/170 |
| 2,795,901 | 6/1957 | Mosbacher | 51/170 |
| 3,214,823 | 11/1965 | Hendrickson | 29/76 |
| 3,785,092 | 1/1974 | Hutchins | 51/170 |
| 3,793,781 | 2/1974 | Hutchins | 51/170 |
| 3,932,963 | 1/1976 | Hutchins | 51/170 |
| 4,052,824 | 10/1977 | Hutchins | 51/170 |
| 4,073,349 | 2/1978 | Sumida | 173/59 |
| 4,145,847 | 3/1979 | Hutchins | 51/170 |
| 4,228,620 | 10/1980 | Hutchins | 51/170 |
| 4,575,973 | 3/1986 | Izumisawa | 51/170 |
| 4,660,329 | 4/1987 | Hutchins | 51/170 |
| 4,671,019 | 6/1987 | Hutchins | 51/170 |
| 5,001,869 | 3/1991 | Hutchins | 51/170 |
| 5,085,012 | 2/1992 | Hutchins | 51/273 |
| 5,319,888 | 6/1994 | Huber et al. | 51/170 |

FOREIGN PATENT DOCUMENTS

| | | | |
|---|---|---|---|
| 0227644 | 7/1987 | European Pat. Off. | 451/344 |

*Primary Examiner*—Robert A. Rose
*Attorney, Agent, or Firm*—Bean, Kauffman & Spencer

[57] ABSTRACT

A reciprocating abrading, polisher or buffing tool is disclosed in which a counterweight for a shoe adapted for the mounting of an abrading, polishing or buffing member is driven by the shoe for oppositely directed reciprocating movement. Pairs of guides for supporting the shoe and counterweight for reciprocating movement are mounted on a shroud having halves fixed to each other and to depend from a rim of a body of the sander or polisher, so as to permit selective rotational displacements of the shoe and counterweight relative to the body. In one form of the invention employing suction to withdraw dust from adjacent the shoe, the shroud is employed to positionally locate an L-shaped connecting duct relative to a dust discharge opening in the shoe and a dust collecting duct leading to an aspirator.

20 Claims, 3 Drawing Sheets

FIG. 4
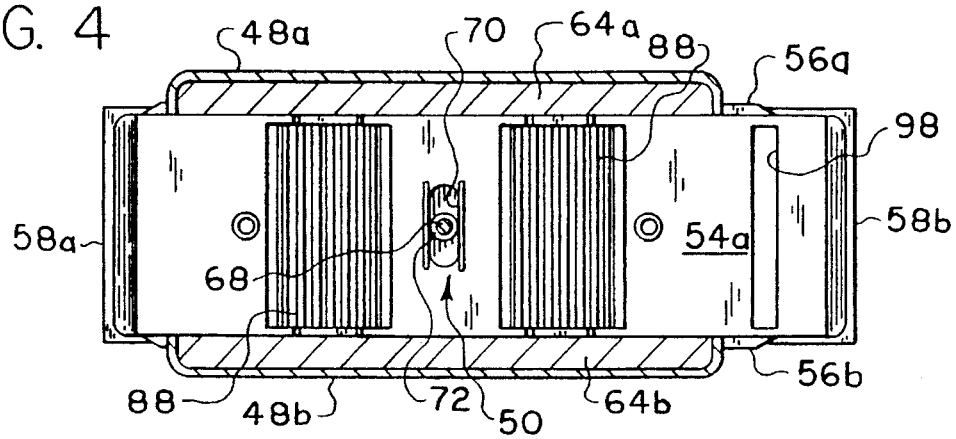
FIG. 5
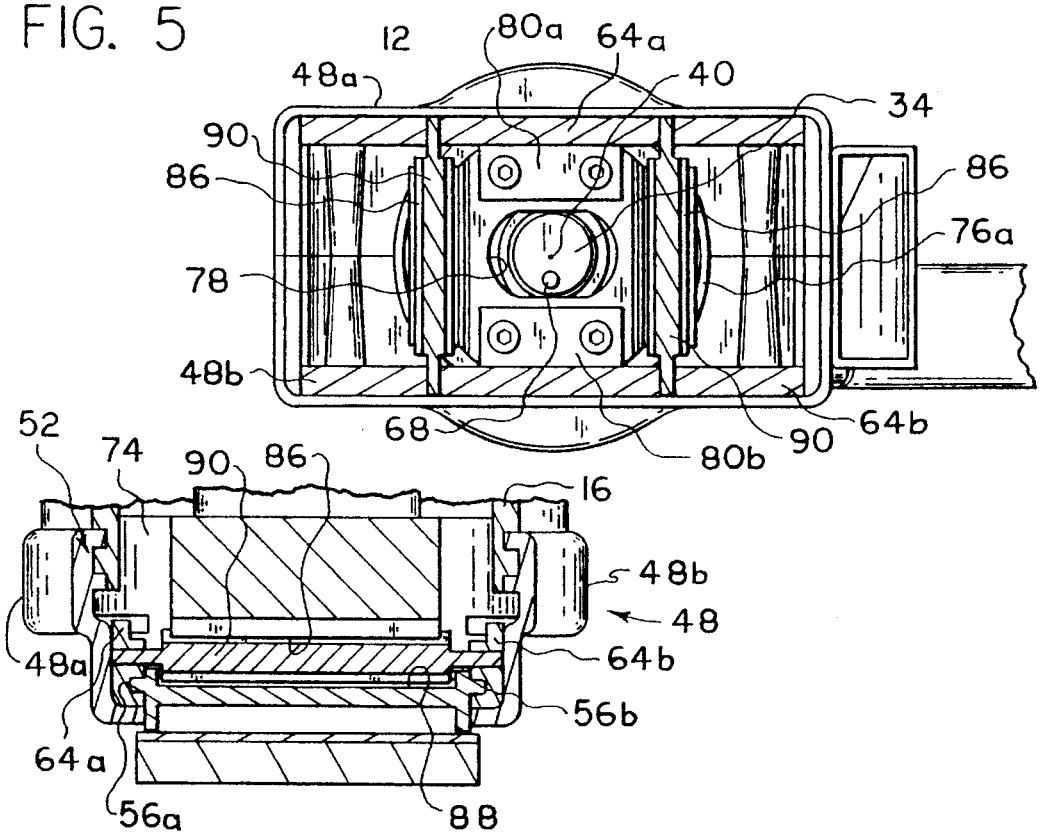
FIG. 6
FIG. 7
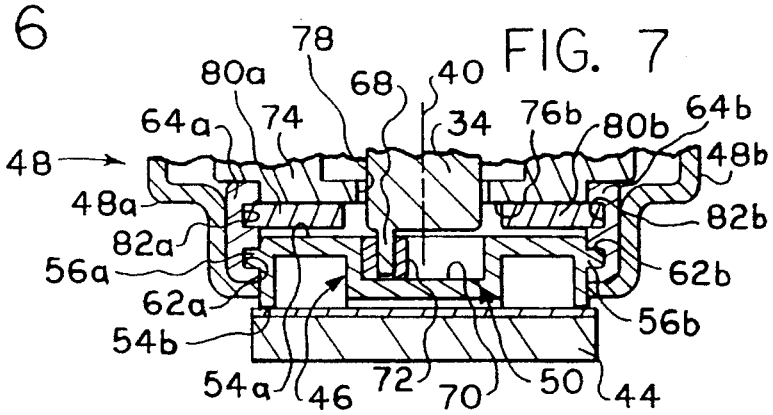

RECIPROCATING SANDER

BACKGROUND OF THE INVENTION

The present invention relates to improvements in portable abrading, polishing and buffing tools of the type having a counterweight and a sanding, polishing or buffing material supporting shoe supported for oppositely directed reciprocating movements in order to minimize vibrations felt by an operator of the tool.

Prior tools of the type described have employed both rotary motors and reciprocating piston type motors, and a suitable transmission permitting both the counterweight and the shoe to be directly coupled to the motor and driven thereby for reciprocating movement. Patents believed representative of prior tools include U.S. Pat. Nos. 2,743,557; 2,830,411; 3,793,781; 4,228,620 and 5,085,012.

SUMMARY OF THE INVENTION

The present invention relates to portable, reciprocating abrading, polishing or buffing tools employing a counterweight drivingly coupled to a shoe adapted for mounting abrading, polishing or buffing material, such that the counterweight is driven by the shoe for reciprocating movement in a direction opposite to that of the shoe.

The shoe and counterweight are supported for reciprocating movement by pairs of guides carried by a shroud fixed to depend from an annular rim defined by the housing of the tool. In a preferred construction, the shroud is defined by shroud halves removably clamped against each other and the annular rim, and the rim and shroud halves are provided with slidably engaging annular ribs and grooves cooperating to support the shroud halves for rotary movement relative to the housing when clamping pressure is removed from the shroud halves. By this arrangement, the direction of reciprocating movement of the shoe and counterweight may be selectively adjusted relative to the housing.

In one form of the invention intended for use in the removal of dust created adjacent a workpiece, the shoe is formed with a through dust discharge opening arranged outwardly of the shroud and the shroud is formed with an outer surface arranged to positionally locate a connecting duct relative to the discharge opening and a dust collecting duct leading to an aspirator driven by air exhausted from the tool.

BRIEF DESCRIPTION OF THE DRAWINGS

The nature and mode of operation of the present invention will now be more fully described in the following detailed description taken with the accompanying drawings wherein:

FIG. 4 is a sectional view taken generally along the line 4—4 in FIG. 3;

FIG. 5 is a sectional view taken generally along the line 5—5 in FIG. 3;

FIG. 6 is a sectional view taken generally along the line 6—6 in FIG. 3;

FIG. 7 is a sectional view taken generally along the line 7—7 in FIG. 3.

DETAILED DESCRIPTION

Figure 1:
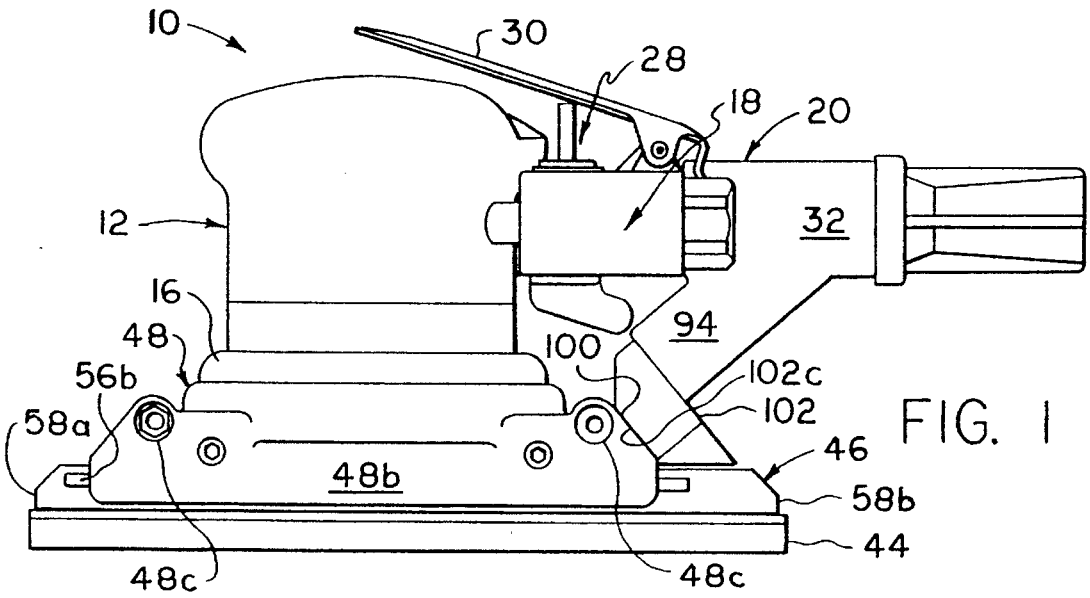
FIG. 1 is a side elevational view of an abrading tool in the form of a reciprocating sander incorporating the present invention.
Figure 2:
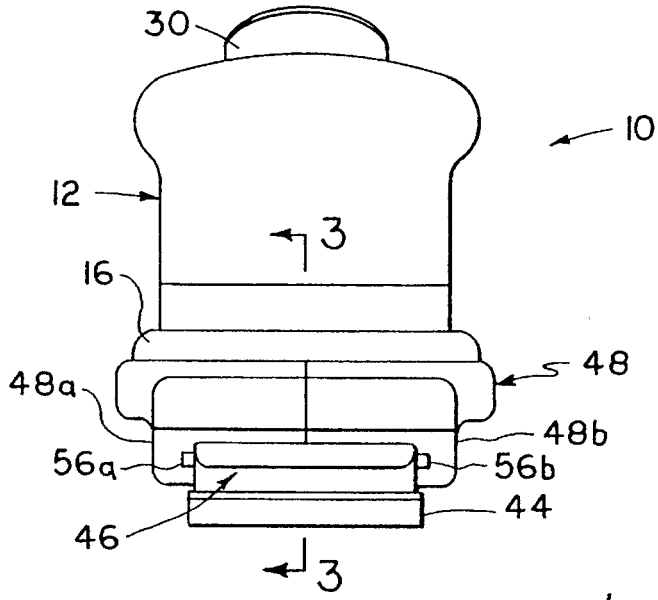
FIG. 2 is a front end elevational view thereof.
Figure 3:
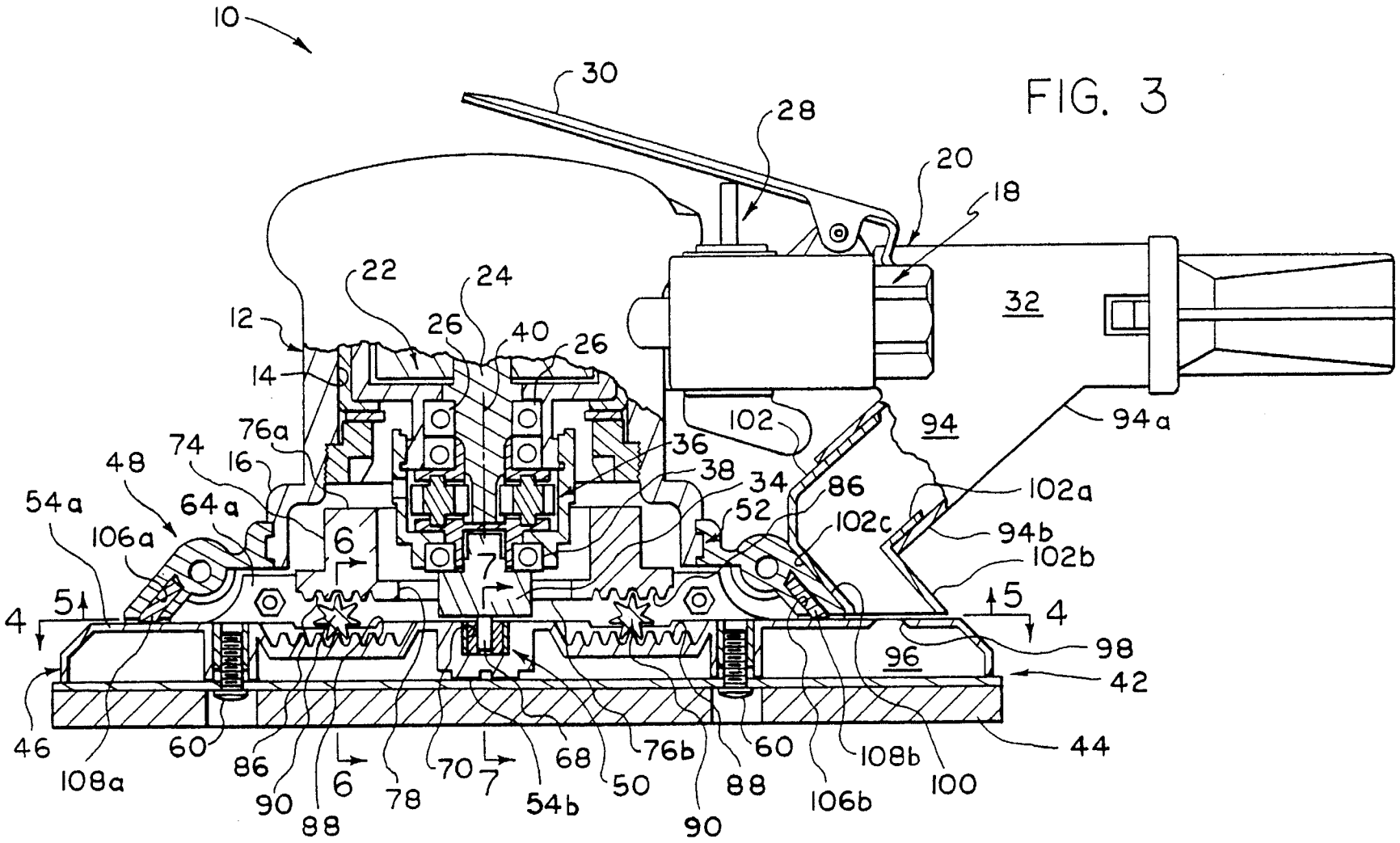
FIG. 3 is a sectional view taken generally along the line 3—3 in FIG. 2.

The present invention shall for purposes of illustration be described as being incorporated in a pneumatically operated, hand held abrading tool in the form of a reciprocating sander generally designated as 10 and shown in FIGS. 1–3 as including a hollow cast or molded housing or body 12, which defines a chamber 14 having a lower open end bounded by a rim 16, an air inlet or supply conduit 18 and an air outlet or discharge conduit 20. Chamber 14 mounts a pneumatically operated rotary motor 22, which is arranged in communication with the air inlet and discharge conduits and has a rotor 24 supported by bearings 26. Flow of air to motor 22 is controlled by a flow control valve 28 manually operable by a housing mounted lever 30, and air discharge from motor 22 via discharge conduit 20 may be passed through air aspirator mechanism 32.

As thus far described, sander 10 is of known construction and reference may be had to U.S. Pat. No. 5,319,888 for a more detailed description of such construction and mode of operation.

In accordance with the present invention, rotor 24 is connected to a rotary drive member 34 by a planetary gearing mechanism 36 with such drive member being supported by further bearings 38 for rotation about a first axis 40 shown in FIGS. 5 and 7, and preferably disposed essentially concentrically of rim 16.

Unlike the sander described in U.S. Pat. No. 5,319,888, the sander of the present invention is intended to impart reciprocating movements to a sanding device 42, such as may be defined by a flexible pad 44 to which sandpaper, not shown, is suitably affixed. To this end, pad 44 is removably fixed to a shoe 46, which is in turn supported for reciprocating movement by a shroud 48 fixed to rim 16 under the control of drive member 34 drivingly coupled to the shoe by a first coupling means in the form of a pin and slot device 50. Preferably, rim 16 is an annular rim and shroud 48 is formed as a pair of halves **48*a* and 48*b* removably and clampingly secured to each other and thus to the rim by clamping fastener screws 48*c*. Also, it is preferable to provide rim 16 and shroud halves 48*a* and 48*b* with a slidably engaging annular rib and groove arrangement 52, which serves to positively position shroud 48 relative to housing 12 in a direction extending lengthwise of axis 40, while permitting rotary adjustment of the shroud and thus shoe 46 relative to the housing as will be described with reference to FIG. 8**.

Shoe 46 is formed with oppositely facing surfaces **54*a* and 54*b* essentially corresponding in size and configuration to pad 44, oppositely facing and parallel side edge surfaces 56*a* and 56*b*, and oppositely facing end edge surfaces 58*a* and 58*b*. Pad 44 is intended to be removably, clampingly secured to shoe surface 54*b* by suitable means, such as screws 60, and shoe surface 54*a* is intended to be disposed in facing relationship to housing 12 and removably supported for reciprocating movement relative thereto by arranging side edge surfaces 56*a* and 56*b* in sliding engagement with a first pair of guide means 62*a* and 62*b*, which are in the form of a pair of facing grooves defined by a pair of guide plates 64*a* and 64*b* suitably fixed to inner surfaces of shroud halves 48*a* and 48*b***, respectively.

Pin and slot device 50 is shown in FIGS. 3–5 and 7 as including a drive pin 68, which is carried by drive member 34 and disposed eccentrically of and parallel to first axis 40, and a slot 70, which is formed to open through shoe surface 54*a* and extend transversely of the direction of reciprocating movement of shoe 46. Preferably, pin 68 is fitted with a bearing sleeve 72 serving to reduce friction as the pin moves back and forth within slot 70 to effect reciprocation of shoe 46 as an incident to rotation of drive member 34.

In accordance with the present invention, vibrations caused by reciprocating movements of shoe 46 and pad 44 relative to housing 12 is substantially reduced by providing a counterweight 74 driven directly by shoe 46 for reciprocating movements in a direction opposite thereto. Counterweight 74 is formed with oppositely facing surfaces 76*a* and 76*b* between which extends a centrally located opening 78 sized to loosely receive drive member 34. A pair of slide plates 80*a* and 80*b*, which are suitably fixed to counterweight lower surface 76*b*, serve to define oppositely facing parallel edge surfaces of counterweight 74 arranged for removable sliding engagement with a second pair of guide means 82*a* and 82*b* in the form of a pair of facing grooves or slots defined by guide plates 64*a* and 64*b*.

A second coupling means is employed to connect shoe 46 to counterweight 74 for effecting reciprocating movement of the counterweight relative to housing 12 in response to reciprocating movement of the shoe. This coupling means is shown in FIGS. 3–6 as including first rack means including a pair of first racks 86,86 carried by counterweight lower surface 76*b* on opposite sides of through opening 78 in alignment with the direction of reciprocation of counterweight 74; a second rack means including a pair of second racks 88,88 carried by shoe upper surface 54*a* for alignment with the first racks; and a pair of gear pins 90,90, which have their opposite ends removably, rotatably supported by guide plates 64*a* and 64*b*, and are arranged to engage with the first and second racks.

As desired, housing 12 may be fitted with differing sizes of counterweights depending on the weights of the shoe, pad and abrasive material intended to be employed. Alternatively, a single size counterweight may be provided and material removed from its upper surface 76*a*, such as by grinding, as required to match its weight to that of the shoe, pad and abrasive material to be employed.

In the form of the invention where air exhausted from motor 22 is passed through aspirator 32 for dust collecting purposes, the aspirator is provided with a dust collecting duct 94 having an upper end 94*a* exposed to the reduced pressure or vacuum condition created by discharged air passing through the aspirator and a lower end 94*b*; shoe 46 defines a dust collection passageway 96 arranged to extend from adjacent a point at which dust to be collected is generated to a discharge opening 98 disposed to face towards the aspirator and be arranged outwardly of shroud 48, as best shown in FIG. 3; and an L-shaped connecting duct 102 is provided to connect discharge opening 98 to dust collecting duct 94. Connecting duct 102 is best shown in FIG. 3 as having an upper end or one of its ends 102*a* sized to be removably, slidably supported by dust collecting duct lower end 94*b*, a lower or other end 102*b* arranged for alignment with discharge opening 98 and a follower surface 102*c*. Engagement of follower surface 102*c* with shroud guide surface 100 serves to position connecting duct upper end 102*a* in flow communication with dust collecting duct lower end 94*b* and to position connecting duct lower end 102*b* in flow alignment with discharge opening 98 and in a slightly spaced or non-contacting relationship with shoe upper surface 54*a* peripherally of the discharge opening. As will be apparent from viewing FIG. 3, connecting duct lower end 102*b* is sized such as to ensure that discharge opening 98 is continuously disposed in flow alignment therewith throughout the range of reciprocating movements of shoe 46. The maintenance of a slight spacing between shoe upper surface 54*a* and duct lower end 102*b* allows for the ingress of ambient air directly into the duct lower end and prevents reduced pressure induced clamping of such duct lower end against shoe 46.

For the vacuum or dust collecting form of sander 10 illustrated in FIGS. 1–7, it is necessary to maintain the illustrated positional relationship of dust collecting duct 94, connecting duct 102, discharge opening 98 and shroud guide surface 100, and thus the orientation of shoe 46, i.e. the direction of its reciprocating movement, relative to housing 12 cannot be adjusted.

As is conventional, pad 44 and the abrasive material carried thereby would typically be provided with passageways, not shown, for placing the interior of shoe 46 in direct flow communication with the surface of a workpiece being sanded.

Again referring to FIG. 3, it will be understood that it is preferable to form opposite ends of shroud 48 with transversely extending slots 106*a* and 106*b*, which are sized to receive flexible sealing strips 108*a* and 108*b* whose free ends are disposed for sliding engagement with shoe upper surface 54*a*. The seal created by sealing strips 108*a* and 108*b* rubbing against shoe surface 54*a*, and the seal created by sliding engagement of guide plates 64*a* and 64*b* with shoe edge surfaces 56*a* and 56*b* results in an effective barrier against the passage of dust inwardly of shroud 48.

Figure 8:
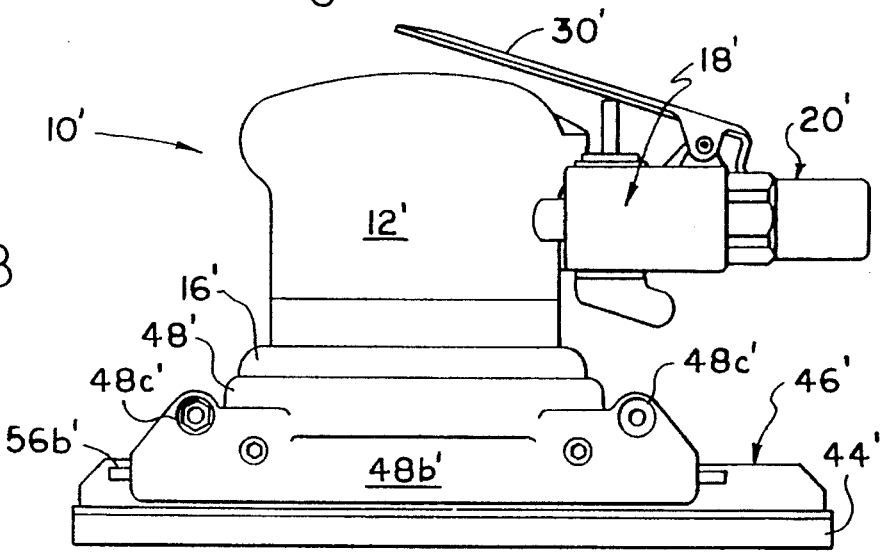
FIG. 8 is a view similar to FIG. 1, but showing another form of the sander incorporating the present invention.

Reference is now made to FIG. 8, wherein a non-vacuum or non-dust collecting type sander is illustrated in which elements thereof similar to those of sander 10 are identified by like primed numerals. In this construction, the absence of previously described dust collecting duct 94, connecting duct 102 and discharge outlet 98 allows the orientation of shoe 46, i.e. the direction of its reciprocating movement relative to housing 12, to be selectively adjusted. This adjustment is effected by the simple operation of loosening screws 48*c*' sufficiently to permit shroud 48' to be rotated relative to annular rim 16' until a desired orientation of shoe 46' relative to housing 12' is achieved and finally tightening such screws sufficiently to frictionally clamp the shroud to the rim.

While the invention has been specifically described for use with a pneumatic motor operated abrading tool in the form of a reciprocating sander, it will be understood that it has utility with sanders employing other suitable types of drive motors, and in similarly constructed buffing or polishing tools, where vibrations are desired to be reduced and/or the orientation of a shoe of the tool is desired to be adjusted relative to its housing.

What is claimed is:

1. A portable tool comprising in combination:

a housing to be held and manipulated by a user;

a motor carried by said housing;

a motor driven drive member supported for rotation about a first axis relative to said housing;

a shoe for mounting an abrading means, said shoe being carried adjacent said housing and supported for reciprocating movement relative thereto;

first coupling means for connecting said drive member to said shoe for effecting reciprocating movement of said shoe relative to said housing in response to rotary movement of said drive member;

a counterweight carried intermediate said housing and said shoe for reciprocating movement relative to said housing parallel to and in alignment with said shoe; and second coupling means separate from said first coupling means for connecting said shoe to said counterweight for effecting reciprocating movement of said counterweight relative to said housing in response to reciprocating movement of and oppositely directed relative to said shoe.

2. A tool according to claim 1, wherein said first coupling means includes a drive pin carried by said drive member and disposed eccentrically of and parallel to said first axis and a slot formed in said shoe and extending transversely of the direction of reciprocating movement of said shoe, and said slot is sized to slidably receive said drive pin.

3. A tool according to claim 1, wherein said second coupling means include first and second rack means carried on facing surfaces of said shoe and said counterweight and gear pin means supported for oscillating rotary movement and being arranged to engage with said first and second rack means.

4. A tool according to claim 1, wherein said counterweight is formed with an opening extending between a pair of spaced surfaces thereof and a pair of edge surfaces extending between said spaced surfaces, said edge surfaces supporting said counterweight for reciprocating movement, and said opening being sized to freely permit passage of said drive member through said counterweight.

5. A tool according to claim 4, wherein said second coupling means includes a first rack means carried by one of said spaced surfaces of said counterweight, a second rack means carried by a surface of said shoe arranged in facing relationship to said one of said spaced surfaces, and gear pin means supported for oscillating rotary movement and being arranged to engage with said first and second rack means.

6. A tool according to claim 4, wherein said second coupling means includes a first pair of rack means carried by one of said spaced surfaces of said counterweight on opposite sides of said opening in alignment with the direction of reciprocation of said counterweight, a second pair of rack means carried by said shoe for alignment with said first pair of rack means, and a pair of rotatably supported gear pins arranged to engage with said first and second pairs of rack means.

7. A tool according to claim 6, wherein said first coupling means includes a drive pin carried by said drive member and disposed eccentrically of and parallel to said first axis and a slot formed in said shoe and extending transversely of the direction of reciprocating movement of said shoe, and said slot is sized to slidably receive said drive pin, and said slot is arranged intermediate said second pair of rack means.

8. A tool according to claim 1, wherein said housing has a rim, and there is additionally provided in combination a shroud removably fixed to depend from said rim, said shroud having first and second halves each formed with facing first guide means for supporting said shoe for reciprocating movement and with facing second guide means for supporting said counterweight for reciprocating movement.

9. A tool according to claim 8, wherein said first coupling means includes a drive pin carried by said drive member and disposed eccentrically of and parallel to said first axis and a slot formed in said shoe and extending transversely of the direction of reciprocating movement of said shoe, said slot is sized to slidably receive said drive pin, and said shroud is supported for rotational movement by said rim thereby to move the direction of reciprocating movement of said shoe and said counterweight relative to said housing.

10. A tool according to claim 8, wherein said first coupling means includes a drive pin carried by said drive member and disposed eccentrically of and parallel to said first axis and a slot formed in said shoe and extending transversely of the direction of reciprocating movement of said shoe, said slot is sized to slidably receive said drive pin, said counterweight is formed with a centrally located opening extending between a pair of spaced surfaces thereof and a pair of edge surfaces, said edge surfaces engaging with said second guide means for supporting said counterweight for reciprocating movement, and said opening is sized to freely permit passage of said drive member through said counterweight.

11. A tool according to claim 10, wherein said second coupling means includes a first pair of rack means carried by one of said spaced surfaces of said counterweight on opposite sides of said opening in alignment with the direction of reciprocation of said counterweight, a second pair of rack means carried by said shoe for alignment with said first pair of rack means, a pair of gear pins arranged to engage with said first and second pairs of rack means, and said gear pins have opposite ends supported for rotation by said first and second halves of said shroud.

12. A tool according to claim 8, wherein said shroud is supported for rotational movement relative to said rim thereby to move the directions of reciprocating movement of said shoe and said counterweight relative to said housing.

13. A tool according to claim 8, wherein said motor is pneumatically operated and means directing air exhausted from said motor creates an aspirator with a dust collecting duct leading to said aspirator, said shoe defines a dust collection passageway means arranged to extend from adjacent a point of generation of dust to be collected to a discharge opening disposed to face generally towards said aspirator and be arranged outwardly of said shroud, said shroud having an exterior guide surface positioned adjacent said discharge opening, and a connecting duct is provided to transfer dust from said discharge opening to said dust collecting duct, said connecting duct having one end sized to be removably slidably inserted into said dust collecting duct, another end and a follower surface arranged to engage with said guide surface of said shroud to removably position said one end within said dust collecting duct and said other end in flow alignment with said discharge opening and in a non-contacting relationship relative to said shoe.

14. A tool according to claim 1, wherein said housing has a chamber for receiving said motor and said chamber has an opening bounded by a rim and opening outwardly of said housing, and there is additionally provided in combination a shroud releasably fixed to said rim and having first guide means for supporting said shoe for reciprocating movement and second guide means for supporting said counterweight for reciprocating movement, said motor is pneumatically operated and means directing air exhausted from said motor creates an aspirator with a dust collecting duct leading to said aspirator, said shoe defines a dust collection passageway means arranged to extend from adjacent a point of generation of dust to be collected to a discharge opening disposed to face generally towards said aspirator and be arranged outwardly of said shroud, said shroud having an exterior guide surface positioned adjacent said discharge opening, and a connecting duct is provided to transfer dust from said discharge opening to said dust collecting duct, said connecting duct having one end sized to be removably slidably supported by said dust collecting duct, another end and a follower surface arranged to engage with said guide surface of said shroud to removably position said one end in flow communication with said dust collecting duct and said other end in flow alignment with said discharge opening and in a non-contacting relationship relative to said shoe.

15. A portable tool comprising in combination:

a housing for enclosing a motor and defining a depending annular rim;

an annular shroud removably fixed to depend from such rim, said shroud having first and second halves formed with parallel first and second pairs of facing guide means;

a shoe for mounting an abrading means, said shoe having a pair of opposite surfaces arranged for a facing relationship with said housing and said abrading means, parallel edge surfaces extending between said opposite surfaces and slidably engaging with said first pair of guide means to support said shoe for reciprocating movement;

a counterweight having a pair of opposite surfaces arranged for a facing relationship with said housing and said shoe, parallel edge surfaces slidably engaging with said second pair of guide means to support said counterweight for reciprocating movement parallel to and in alignment with said shoe, and an opening extending between said opposite surfaces of said counterweight;

a rotary drive means drivingly coupled at one end thereof to said motor and drivingly coupled at an opposite end thereof with said shoe by a pin and slot device thereby to impart reciprocating movement to said shoe in response to rotational movement of said rotary drive means, said rotary drive means freely extending through said opening of said counterweight; and means separate from said rotary drive means for coupling said counterweight to said shoe thereby to impart oppositely directed reciprocating movement to said counterweight in response to reciprocating movement of said shoe.

16. A tool according to claim 15, wherein said shroud is releasably clamped to said rim to permit the position of said shroud to be adjusted in a direction extending annularly of said rim, thereby to permit the direction of reciprocation of said shoe and counterweight to be adjusted relative to said housing.

17. A tool according to claim 15, wherein said rim and shroud halves have annular, removably interengaging rib and groove means for supporting said shroud on said rim for rotational movement relative to said housing, and said shroud halves are releasably clamped together and in clamping engagement with said rim by threaded fastener means extending between said shroud halves.

18. A tool according to claim 15, wherein said means for coupling said counterweight to said shoe includes a first pair and second pair of rack means carried on facing ones of said opposite surfaces of said shoe and said counterweight, and a pair of parallel gear pins arranged to engage with said first and second pairs of rack means to affect oppositely directed reciprocating movement of said counterweight in response to reciprocating movement of said shoe, and opposite ends of said gear pins are rotatably supported one by each of said halves of said shroud.

19. A tool according to claim 18, wherein said rim and shroud halves have annular, removably interengaging rib and groove means for supporting said shroud on said rim for rotational movement relative to said housing, and said shroud halves are releasably clamped together and in clamping engagement with said rim by threaded fastener means extending between said shroud halves.

20. A tool according to claim 15, wherein said shroud halves cooperate to support a pair of parallel seal devices arranged to engage with one of said pairs of opposite surfaces of said shoe arranged in facing relationship with said housing and in a pair of surface areas thereof spaced apart in the direction of reciprocation of said shoe.

* * * * *